US006398155B1

(12) United States Patent
Hepner et al.

(10) Patent No.: US 6,398,155 B1
(45) Date of Patent: Jun. 4, 2002

(54) METHOD AND SYSTEM FOR DETERMINING THE POINTING DIRECTION OF A BODY IN FLIGHT

(75) Inventors: David J. Hepner, Elkton; Thomas E. Harkins, Joppa, both of MD (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 09/751,924

(22) Filed: Jan. 2, 2001

(51) Int. Cl.[7] ..... F41G 7/00

(52) U.S. Cl. ..... 244/3.15; 244/3.16; 244/3.17; 244/3.19; 244/3.21; 342/63

(58) Field of Search ..... 244/3.1–3.22, 244/3.23; 342/61, 62, 63, 64, 65, 385, 386, 407; 89/1.51, 1.56, 1.6, 1.61; 356/4.01, 5.01, 5.05, 5.08, 27, 28

(56) References Cited

U.S. PATENT DOCUMENTS 2,956,278 A * 10/1960 Branchu ..... 342/407
3,631,485 A * 12/1971 Beazell, Jr. ..... 342/59
3,677,500 A * 7/1972 Brown et al. ..... 244/3.13
3,698,811 A * 10/1972 Weil ..... 356/5.08
4,030,686 A * 6/1977 Buchman ..... 244/3.13
4,058,275 A * 11/1977 Banks et al. ..... 244/3.15

* cited by examiner

*Primary Examiner*—Bernarr E. Gregory
(74) *Attorney, Agent, or Firm*—Paul S. Clohan, Jr.

(57) ABSTRACT

A method to determine the direction in which a spinning projectile is traveling. A solar sensor array on the projectile is used to calculate the orientation of the axis of rotation of the projectile with respect to a known solar field and a magnetometer sensor array is used to calculate the orientation of the axis of rotation of the projectile with respect to a known magnetic field, both fields being represented by respective vectors having magnitude and direction. With the known and calculated orientations, the pointing direction may be obtained by vector combination.

10 Claims, 5 Drawing Sheets

METHOD AND SYSTEM FOR DETERMINING THE POINTING DIRECTION OF A BODY IN FLIGHT

STATEMENT OF GOVERNMENT INTEREST

The invention described herein may be manufactured and used by or for the Government of the United States of America for government purposes without the payment of any royalties therefor.

BACKGROUND OF THE INVENTION

Accurate measurement of the angular motions of a spinning body contributes significantly to the development of experimental projectiles and rockets, and to the diagnosis of existing munitions and weapons systems. Such measurements can in some cases be made using high-speed photography but this technique is generally used for only limited portions of a projectile flight for reasons of both expense and practicability. Also, the precision of angular measurements is limited in this methodology. Another measurement technique used for obtaining angle of attack data is yaw cards but this technique is low resolution and provides only a small number of discrete data points along a trajectory. Some kind of on-board inertial angular rate sensor would seem a logical candidate for obtaining continuous data throughout a flight, but expense is often an issue and there are a host of problems associated with using such devices in high spin and high-g environments.

In developmental work, continuous in-flight angular orientation histories can be used for projectile aerodynamic characterization, test and evaluation of guidance and maneuver systems, and provide a truth measure for the test and evaluation of other pointing angle measurement systems, such as rate integrating inertial systems. The determination of the navigation pointing angle is of importance for the effectiveness of guidance and terminal seeking systems and advanced video imaging systems for target location, by way of example.

Restricted slit silicon solar cells have been used to indicate the solar attitude and roll rate of projectiles. A spinning projectile with optical sensors provides a pulse train, which when combined with calibration data, provides measurable quantities of the solar attitude and solar roll history. An optical sensor suitable for high-resolution solar attitude measurements is described in U.S. Pat. No. 5,909,275, which is hereby incorporated by reference. The variation in roll position of a tilted solar sensor when aligned with the solar plane is indicative of the angle between the axis of rotation of the projectile and the parallel light source. Using a variety of sensor orientations on a spinning body, a unique solution to the angle, $\sigma_s$, between the light source and the axis of rotation can be determined from a time-stamped history of solar alignment. Even though the angle between the axis of rotation and the solar vector can be determined, there are infinite orientations within the navigation system for which the angle, $\sigma_s$, has the same value.

In another development, described in U.S. patent application entitled "Method and System for Determining Magnetic Attitude," having inventors T. Harkins, D. Hepner and B. Davis, Ser. No. 09/751,925, filed Jan. 2, 2000 now U.S. Pat. No. 6,347,763, which application is hereby expressly incorporated by reference, a magnetic sensor array utilizes the outputs of one or more magnetometers, each having a sensitive axis, to obtain the orientation of the axis of rotation of a spinning body relative to a magnetic plane. The magnetic plane is defined by the body axis of rotation and a magnetic field vector. The angle between a magnetometer sensitive axis and the axis of rotation of the body is defined as lambda ($\lambda$). With an array utilizing two magnetometer sensors at respective distinct and non-supplementary angles, $\lambda_1$ and $\lambda_2$, a unique determination may be made of $\sigma_M$, the angle between the magnetic field and the axis of rotation for the spinning body. However, like the solar sensor array described above, there are infinite orientations within the navigation system where the angle, $\sigma_M$, is a constant.

Accordingly, it is the primary object of the present invention to provide an arrangement, and a simple, robust methodology, wherein an on-board, multi-sensor system solution completely determines the orientation of an axis of rotation of a spinning body with respect to a convenient navigation system.

SUMMARY OF THE INVENTION

The present invention is a system and a methodology wherein a multiple field environment is utilized to determine the orientation of a spinning body within a convenient navigation coordinate system. An example is described containing a constellation of optical and magnetic sensors. Methodologies are developed for data processing to generate angular orientation in real-time or post-flight. Potential applications for the obtained data include determination of angular motion histories of experimental, developmental and tactical projectiles. The resulting angle data can be utilized with diagnostic tools for projectile aeroballistic characterization, determination of maneuver authority for guided munitions, and weapon/projectile/payload interaction analysis. The processed data can also provide a relative roll orientation and roll rate reference for calibration of on-board data sources such as accelerometers and angular rate sensors. Finally, the combination of magnetic sensors and on-board processing of data potentially provides navigation assistance for "jammed" GPS fitted munitions.

The determination of the orientation of a spinning body, that is, the pointing direction, is accomplished with first and second sensor arrays on board the body in flight. The first array is responsive to a first field, such as a solar field, represented by a vector having magnitude and direction. The array is utilized to obtain a value for the orientation of the axis of rotation of the body with respect to the first field direction, which is known. The second array is responsive to a second field, such as the earth's magnetic field, represented by a vector having magnitude and direction. The second array is utilized to obtain a value for the orientation of the axis of rotation of the body with respect to the second field direction, which is also known. By vectorily combining the known and obtained values, the pointing direction may be determined.

BRIEF DESCRIPTION OF THE DRAWINGS

The invention will be better understood, and further objects, features and advantages thereof will become more apparent from the following description of the preferred embodiment, taken in conjunction with the accompanying drawings, in which.

DETAILED DESCRIPTION OF THE PREFERRED EMBODIMENTS

Figure 1:
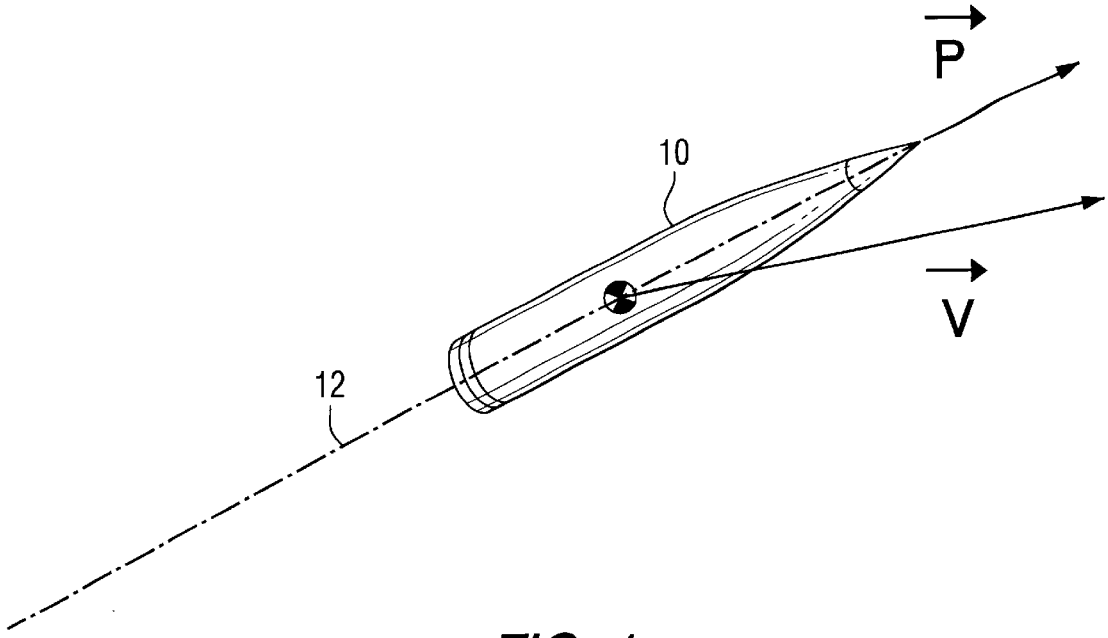
FIG. 1 is a view of a projectile in flight, and illustrates a velocity vector as well as a pointing vector.

In the drawings, which are not necessarily to scale, like or corresponding parts are denoted by like or corresponding reference numerals.

FIG. 1 shows a body, in the form of a projectile 10, in flight, and spinning about an axis of rotation 12, commonly called a spin axis. FIG. 1 also illustrates the velocity vector $\vec{V}$, as well as the navigation pointing vector $\vec{P}$, for the projectile. Due to various factors such as the dynamics of spin, atmospheric conditions and gravity, it is seen that the velocity vector and navigation pointing vectors are not collinear. Although the velocity of the projectile 10 may be determined, such as by use of the global positioning system (GPS) or other systems, knowledge of this velocity does not indicate the pointing vector. If the need exists for understanding how the projectile is flying or where it is pointed when taking a picture, or seeking a target, for example, then the pointing vector must be determined. The present invention provides a solution to this problem.

Figure 2A:
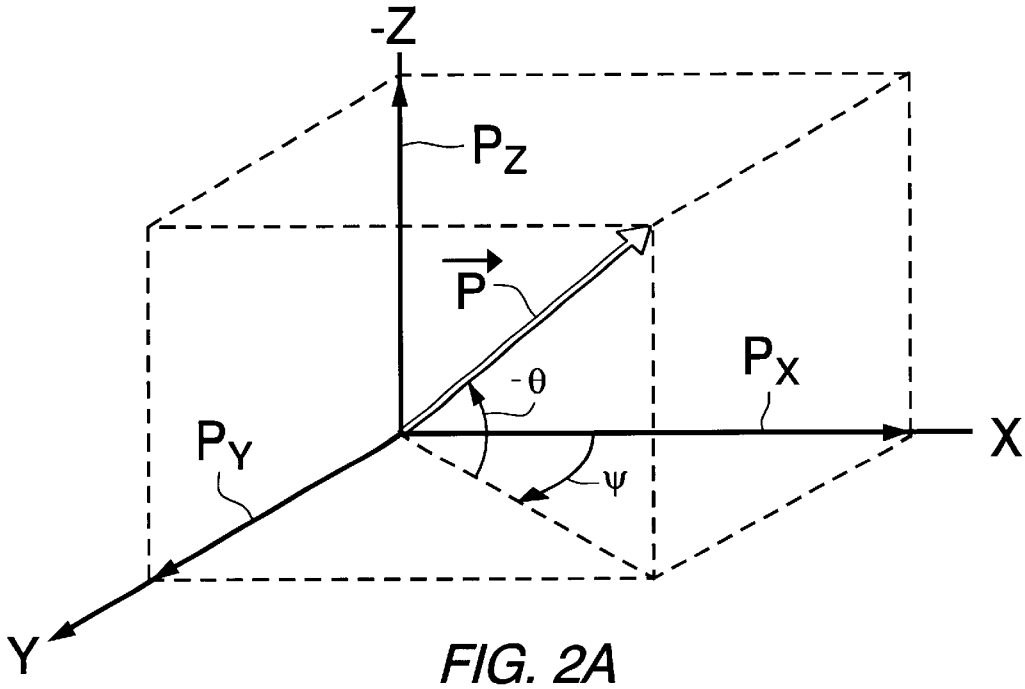
FIG. 2A illustrates the pointing vector of FIG. 1 in an XYZ coordinate system.

FIG. 2A illustrates the pointing vector $\vec{P}$, in an XYZ coordinate system whereby the magnitude of the vector may be defined by the scalar quantities $P_X$, $P_Y$ and $P_Z$, lying along respective axes X, Y and −Z, and the spatial orientation of the vector may be defined by the elevation angle −θ and azimuth angle ψ shown in FIG. 2A.

In the present invention, an indication is obtained of the angle that the axis of rotation (the pointing direction) makes with respect to the direction of two separate fields. Each of the fields is represented by a respective vector having magnitude and direction and for purposes of illustration, one of the fields will be a solar field and the other will be the earth's magnetic field. Knowing the general longitude and latitude of the projectile's location on the earth, as well as the time of day, the orientation of each of the two fields may be ascertained from known tables.

Figure 2B:
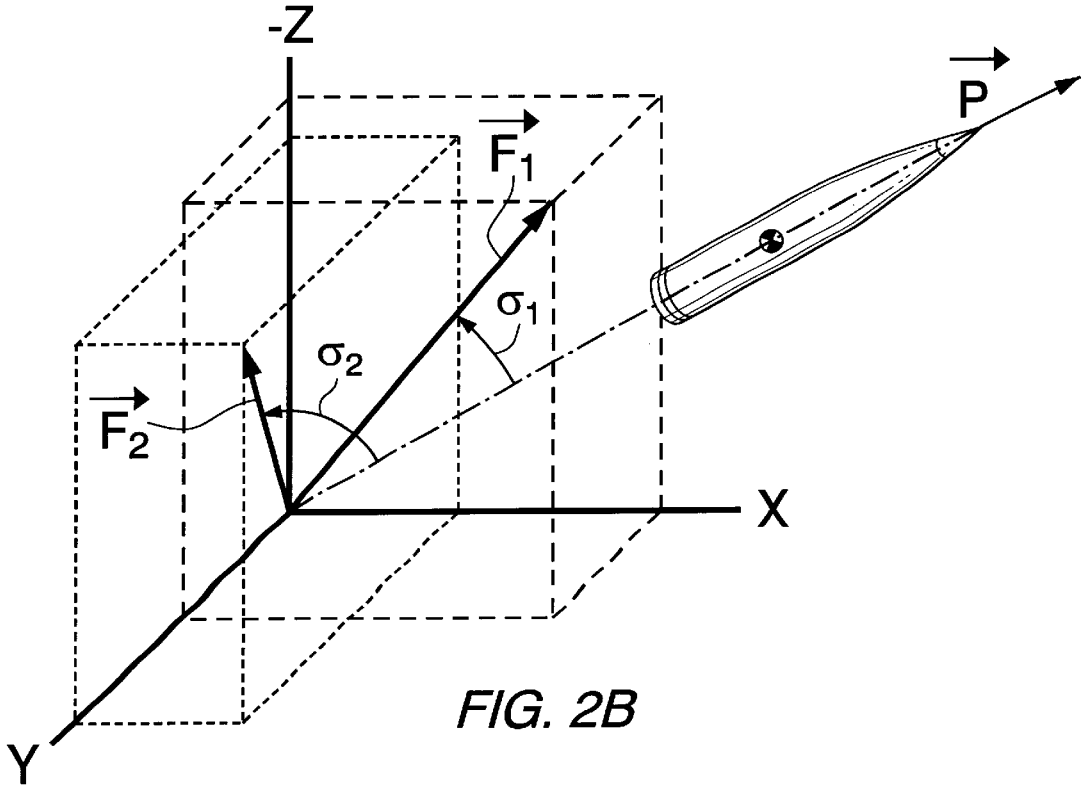
FIG. 2B illustrates field vectors in an XYZ coordinate system.

FIG. 2B illustrates a vector $\vec{F}_1$, representing a first field, the solar field, in a coordinate system which includes the pointing vector, so as to define an angle $\sigma_1$, the angle that the axis of rotation makes with the solar field, in which vector $\vec{F}_1$ lies. Similarly, FIG. 2B also illustrates a vector $\vec{F}_2$, representing a second field, the magnetic field, in a coordinate system which includes the pointing vector, so as to define an angle $\sigma_2$, the angle that the axis of rotation makes with the magnetic field, in which vector $\vec{F}_2$ lies.

Let the unit vectors $\bar{P}$, $\bar{F}_1$, and $\bar{F}_2$ along $\vec{P}$, $\vec{F}_1$, and $\vec{F}_2$ be defined within the X, Y, Z coordinate system as:

$$\bar{P}=(P_X, P_Y, P_Z)$$

$$\bar{F}_1=(F_{1X}, F_{1Y}, F_{1Z})$$

$$\bar{F}_2=(F_{2X}, F_{2Y}, F_{2Z}) \tag{1}$$

The components of $\bar{P}$ are obtained from the simultaneous solution of the system:

$$\bar{P}\cdot\bar{F}_1=\cos(\sigma_1)$$

$$\bar{P}\cdot\bar{F}_2=\cos(\sigma_2)$$

$$|\bar{P}|=1 \tag{2}$$

where the first two mathematical expressions of equation (2), in vector notation, are the dot products with unit vectors, and with $\bar{F}_1$, $\bar{F}_2$, $\sigma_1$, $\sigma_2$ being known, estimated, or measured. The angle $\sigma_1$ corresponds to the derived angle $\sigma_S$ and the angle $\sigma_2$ corresponds to the derived angle $\sigma_M$ previously mentioned. The pointing angles are then given by:

$$\theta = \tan^{-1}\left(\frac{P_Z}{\sqrt{P_X^2 + P_y^2}}\right) \tag{3}$$

$$\psi = \tan^{-1}\left(\frac{P_Y}{P_X}\right)$$

The methodology yields two possible, diametrically opposed pointing angle solutions. Knowledge of the initial navigation orientation resolves this trivial ambiguity. Furthermore, a unique and accurate solution can be maintained as long as vectors $\bar{P}$, $\bar{F}_1$, and $\bar{F}_2$ are sufficiently distinct. Accuracy will suffer as any pair of these vectors approaches co-linearity, but the use of the solar and magnetic fields in the exemplary embodiment reduces the possibilities of conjunction of the fields to only cases of no practical interest.

The accuracy and resolution of the navigation angle solution is dependent on the resolutions of the angular measurements with respect to the two fields and the accuracy of the knowledge of the field orientations. Given that the angle of the projectile with respect to each of the fields can be estimated to within 0.1 degrees and the orientations of the fields can be estimated to within 0.25 degrees, the system of the present invention can provide the navigation pointing angle to within 0.5 degrees. Numerical difficulties arising from small denominators in equation (3) can be avoided by choosing a favorable coordinate system.

Figure 3A:
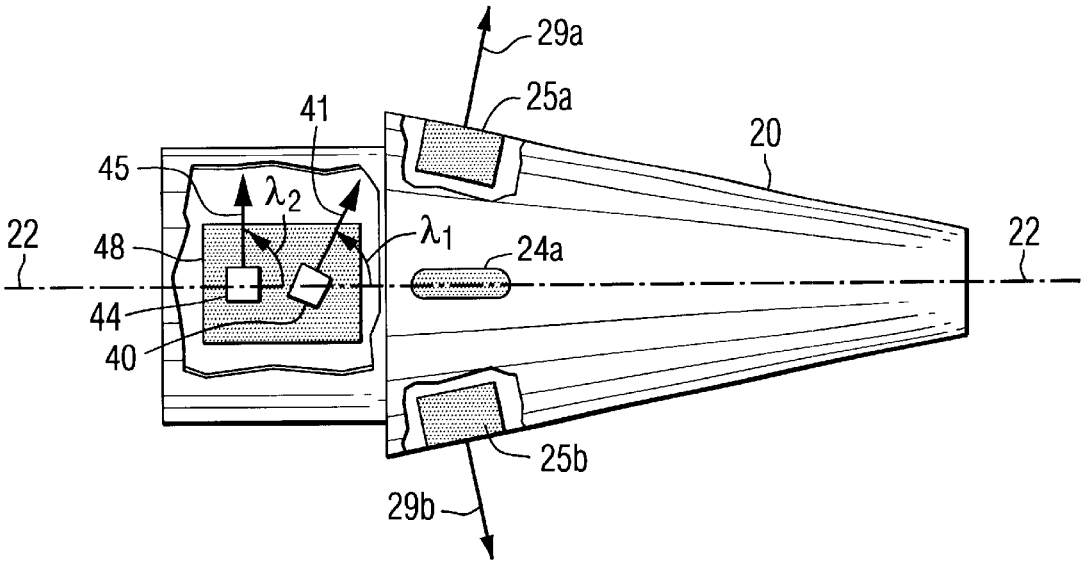
FIG. 3A is a side view of a body which spins about an axis of rotation and carries sensor subsystems.
Figure 3B:
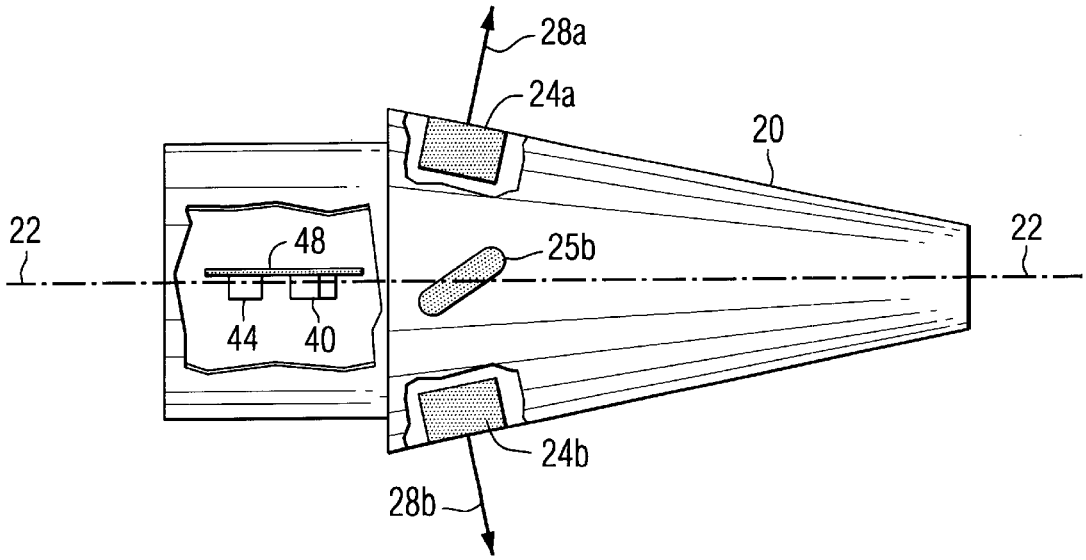
FIG. 3B is a plan view of the body of FIG. 3A

In the system of the present invention, two known subsystems are utilized to respectively derive the angles $\sigma_S$ and $\sigma_M$ to arrive at the pointing vector orientation, in accordance with the above equations. With reference to FIGS. 3A and 3B, there is illustrated a respective side view and plan view of a spinning body 20, having an axis of rotation 22 and which may, for example, be a fuze attached to an artillery shell (not shown). The first subsystem includes a plurality of solar responsive sensors 24*a* and 24*b*, diametrically opposed, and 25*a* and 25*b*, diametrically opposed and fitted into body 20 and symmetrically disposed about the axis of rotation 22 in a manner that sensors 24*a* and 24*b* are aligned with the axis of rotation 22 and sensors 25*a* and 25*b* are skewed with respect to the axis of rotation 22. Each of the sensors has a respective sensor axis 28*a* and 28*b*, and 29*a* and 29*b*. As the body 20 rotates during flight, each of the sensors will sequentially provide an output pulse signal as it views the sun.

The second subsystem includes a sensor array responsive to the magnetic field. By way of example the magnetic sensor array includes a first magnetometer 40, having a sensitive axis 41, and a second magnetometer 44, having a sensitive axis 45. The magnetometers are arranged on a circuit board 48 such that axis 41 is at an angle $\lambda_1$ with respect to the axis of rotation 22 and axis 45 is at an angle $\lambda_2$ with respect to the axis of rotation 22, where $\lambda_1$ and $\lambda_2$ are non-supplementary. As the body 20 rotates during flight, each of the magnetometers will provide a respective sinusoidal output signal experiencing a positive maximum and a negative minimum. Intermediate these two maximum and minimum values, the waveform passes through zero.

The solar sensor signals and the magnetometer signals may then be transmitted to a ground station for processing by telemetry circuitry (not illustrated) which may be carried by circuit board 48. In order to reduce the number of signal channels required for telemetry, the solar sensor signals and the magnetometer signals may be combined on-board Another benefit of this on-board mixing is that phase and amplitude errors introduced by multi-channel telemetry are reduced.

Figure 4:
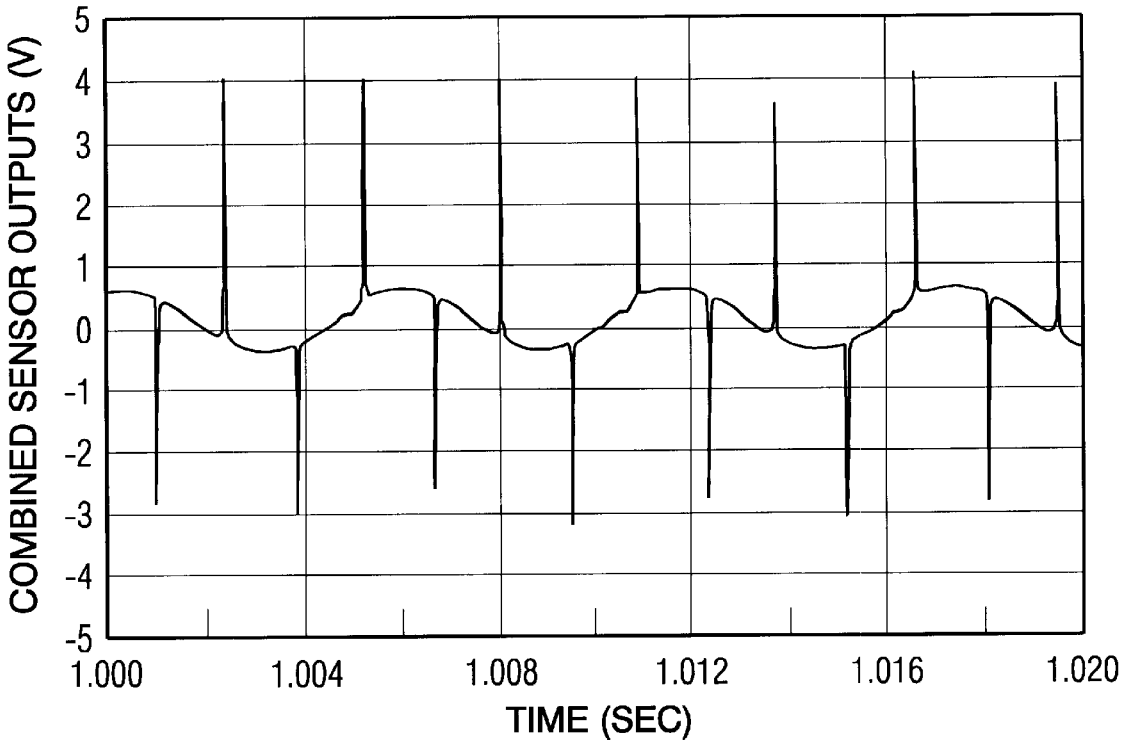
FIG. 4 is a waveform illustrating sensor outputs.

FIG. 4 illustrates an actual presentation of such combined data, obtained from a spinning artillery shell, over several roll cycles. For the test, only one magnetometer, 40, was used and produced the sinusoidal waveform. The zero crossings of this waveform are used to create a time discriminant, as more fully described in the aforementioned copending patent application. The time discriminant is then compared in a look-up table with a comparable roll angle discriminant, associated with a particular $\sigma_M$, and previously determined from a laboratory set-up prior to flight. Thus, the time discriminant, obtained from the magnetometer output results in a known $\sigma_M$ one of the values (i.e., $\sigma_2$) required for equation (2).

In a similar fashion, the time occurrences of the solar output pulses are used to obtain a time discriminant which is then compared in a look-up table with a comparable roll angle discriminant, associated with a particular $\sigma_S$, and previously determined from a laboratory set-up prior to flight. Thus, the time discriminant, obtained from the output of the solar sensors results in a known $\sigma_S$, one of the other values (i.e., $\sigma_1$) required for equation (2).

Figure 5:
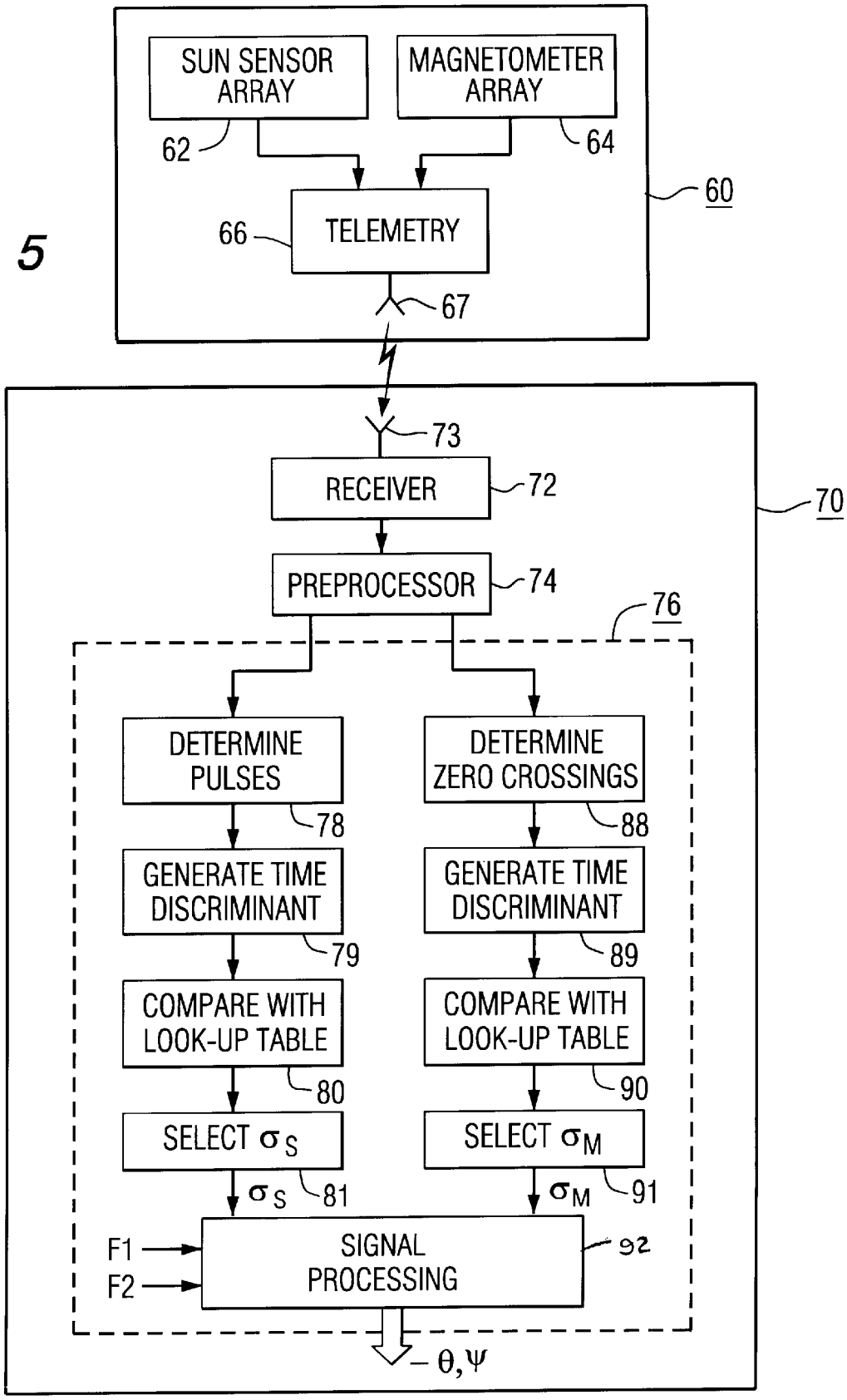
FIG. 5 is a block diagram of one arrangement of the present invention.

For research and testing applications of the system, typical sensor data collection methods include telemetry transmission back to a ground station, such as illustrated in FIG. 5. A body in flight and which rotates around an axis of rotation during flight is depicted by numeral 60. The body 60 carries a solar sensor array 62, and a magnetometer sensor array 64, comprised of one or more magnetometers, as previously described. The output signals from the sensor arrays 62 and 64 are provided to a telemetry unit 66, having an antenna 67, for transmission of the data to a ground station 70.

Various methods of data collections can be used for telemetry applications such as analog data via FM/FM or digital data via pulse code modulation (PCM). Analog applications include FM/FM telemetry using high frequency voltage-controlled oscillators. Analog reduction techniques employing ground-based analog-to-digital conversion and curve fitting may be used to determine the instants of zero crossings of the magnetometer signal. Digital applications would primarily use on board PCM systems to digitize the entire raw data traces for telemetry. The ultimate objective is to acquire a temporal history of critical data points within the sensors time histories from which to derive the individual angular measurements $\sigma_S$ and $\sigma_M$.

These angles $\sigma_S$ and $\sigma_M$ are then used to determine the navigation orientation of the axis of rotation (the pointing angle) as previously described. All available data are collected and archived, and can be processed in the field environment to provide feedback during a test and enhance the flexibility of the test requirements. Advanced reduction techniques can be substituted when appropriate, including, but not limited to, compensation for rapid changes in either aspect angle or spin rate.

In one embodiment, the ground station 70 includes a receiver 72, with associated antenna 73, for receiving the transmitted data from the body 60. A preprocessor 74 is operable to separate the solar and magnetometer sensor outputs and provide them to a signal processing means such as microprocessor 76. As indicated by steps 78 to 81, the microprocessor 76 obtains an indication of $\sigma_S$ as the output of step 81. Similarly, steps 88 to 91 derive the angle $\sigma_M$ at the output of step 91. These two values are provided to signal processing unit 92, which also receives the known orientation values of the solar vector and magnetic field vector, and computes the value for $\theta$ and $\psi$, in accordance with equations (1), (2) and (3). Having $\theta$ and $\psi$, the pointing vector orientation is defined.

Figure 6:
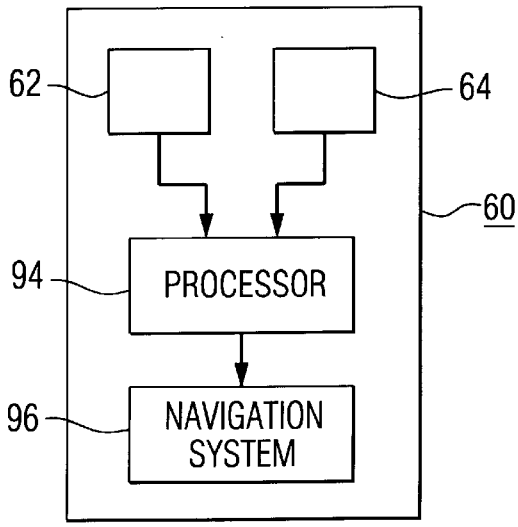
FIG. 6 is a block diagram of another arrangement of the present invention.

The system of the present invention also lends itself to real-time, on-board determination of the navigation pointing angle. As illustrated in FIG. 6, this application requires the addition of an on-board processor 94 capable of carrying the appropriate signal processing as previously described. With this embodiment the system can be used in inertial measurement and navigation systems. For example, the processor 94 can be used to provide the computed data to an on-board navigation system 96 for directional control of the body 60.

Although the invention has been described by way of example utilizing solar and magnetic fields, other fields are applicable. Other examples of reference fields that can be determined and sensed include telemetry radio frequency (RF) fields, GPS RF fields, millimeter wave radar, and passive radiometric fields. The sole requirement of the field sensors is that they provide a response of some nature that will indicate orientation with respect to that field.

It will be readily seen by one of ordinary skill in the art that the present invention fulfills all of the objects set forth herein. After reading the foregoing specification, one of ordinary skill in the art will be able to effect various changes, substitutions of equivalents and various other aspects of the present invention as broadly disclosed herein. It is therefore intended that the protection granted hereon be limited only by the definition contained in the appended claims and equivalents. Having thus shown and described what is at present considered to be the preferred embodiment of the present invention, it should be noted that the same has been made by way of illustration and not limitation. Accordingly, all modifications, alterations and changes coming within the spirit and scope of the present invention are herein meant to be included.

What is claimed is:

1. A method of determining the pointing direction of a body in flight and spinning about an axis of rotation, comprising the steps of:

providing a first sensor array in said body to obtain a first value indicative of the orientation of said axis of rotation with respect to a first field, represented by a vector having magnitude and direction;

providing a second sensor array in said body to obtain a second value indicative of the orientation of said axis of rotation with respect to a second field, represented by a vector having magnitude and direction;

obtaining an indication of the direction of said first field;

obtaining an indication of the direction of said second field;

determining said pointing direction by vectorily combining said first and second values of orientation and said first and second indications of the direction of said fields.

2. A method according to claim 1 wherein said body is traveling in an XYZ coordinate system and which includes the steps of:

determining said pointing direction by obtaining the azimuth and elevation angles of said axis of rotation, from said vector combination.

3. A method according to claim 1 which includes the steps of:

measuring the direction of a solar field, constituting said first field.

4. A method according to claim 3 which includes the steps of:

providing a first sensor array of solar sensors around the periphery of said body.

5. A method according to claim 4 which includes the steps of:

providing four said solar sensors, two diametrically opposed and in line with said axis of rotation and two diametrically opposed and skewed with respect to said axis of rotation.

6. A method according to claim 1 which includes the steps of:

measuring the direction of a magnetic field, constituting said second field.

7. A method according to claim 6 which includes the steps of:

providing a second sensor array of magnetometers within said body, each said magnetometer having sensitive axis.

8. A method according to claim 7 which includes the steps of:

providing two said magnetometers, one at an angle $\lambda_1$ with respect to said axis of rotation and the other at an angle $\lambda_2$ with respect to said axis of rotation, where $\lambda_1$ and $\lambda_2$ are non-supplementary.

9. A method according to claim 1 wherein said sensor arrays provide respective output signals and which includes the steps of:

transmitting said output signals to a remote ground station;

determining said pointing direction at said ground station.

10. A method according to claim 9 wherein:

said output signals from said first sensor array and said output signals from said second sensor array are transmitted over a single data channel.

* * * * *